US010820102B1

(12) United States Patent
Hwang

(10) Patent No.: US 10,820,102 B1
(45) Date of Patent: Oct. 27, 2020

(54) VEHICLE AND METHOD OF CONTROLLING THE SAME

(71) Applicants: HYUNDAI MOTOR COMPANY, Seoul (KR); KIA MOTORS CORPORATION, Seoul (KR)

(72) Inventor: Yonghwan Hwang, Hwaseong-si (KR)

(73) Assignees: Hyundai Motor Company, Seoul (KR); KIA Motors Corporation, Seoul (KR)

( * ) Notice: Subject to any disclaimer, the term of this patent is extended or adjusted under 35 U.S.C. 154(b) by 0 days.

(21) Appl. No.: 16/596,253

(22) Filed: Oct. 8, 2019

(30) Foreign Application Priority Data

Jul. 8, 2019 (KR) ..... 10-2019-0082137

(51) Int. Cl.

| | |
|---|---|
| ***H04R 1/02*** | (2006.01) |
| ***H04R 3/04*** | (2006.01) |
| ***H04R 1/40*** | (2006.01) |

(52) U.S. Cl.
CPC ..... *H04R 3/04* (2013.01); *H04R 1/025* (2013.01); *H04R 1/403* (2013.01); *H04R 2499/13* (2013.01)

(58) Field of Classification Search
CPC ..... H04R 2411/13; H04R 2201/02; H04R 2201/021; H04R 1/40; H04R 1/403
See application file for complete search history.

(56) References Cited

U.S. PATENT DOCUMENTS

2018/0007466 A1* 1/2018 Hess ..... H04R 1/26

* cited by examiner

*Primary Examiner* — Kile O Blair
(74) *Attorney, Agent, or Firm* — Brinks Gilson & Lione

(57) ABSTRACT

A vehicle and a method of controlling the vehicle are provided. The vehicle may include: a first subwoofer provided at a driver's seat side of the vehicle and having a first resonance frequency; a second subwoofer provided on a passenger seat side of the vehicle and having a second resonance frequency; and a controller configured to transmit an electrical signal corresponding to a play sound to the first subwoofer, to invert a phase of the electrical signal, and to transmit the inverted electrical signal to the second subwoofer.

14 Claims, 9 Drawing Sheets

VEHICLE AND METHOD OF CONTROLLING THE SAME

CROSS-REFERENCE TO RELATED APPLICATION(S)

The present application claims priority to and the benefit of Korean Patent Application No. 10-2019-0082137, filed on Jul. 8, 2019, which is incorporated herein by reference in its entirety.

TECHNICAL FIELD

The present disclosure relates to a vehicle that provides a high sensitivity low frequency sound, and a method of controlling the vehicle.

BACKGROUND

The statements in this section merely provide background information related to the present disclosure and may not constitute prior art.

Generally, subwoofers provide a sound of a low frequency band. In detail, the subwoofer may extract and output the sound corresponding to the low frequency band among sounds.

Recently, the subwoofer is installed in a vehicle to provide a richer sound to a driver of the vehicle. However, due to the nature of the subwoofer needs a large space enclosure, there may be a limit to an output of the subwoofer provided in the vehicle.

Therefore, although a design method using an interior space of a side chamber for reinforcing side stiffness of the vehicle as the enclosure of the subwoofer and a design method utilizing a plurality of subwoofers have been applied, low sensitivity of the subwoofer may be a concern.

SUMMARY

The present disclosure provides a vehicle capable of increasing a sensitivity of a subwoofer in the vehicle by using a phase difference between a plurality of subwoofers, and a method of controlling the vehicle.

Additional aspects of the present disclosure will be set forth in part in the description which follows and, in part, will be obvious from the description, or may be learned by practice of the disclosure.

In one form of the present disclosure, a vehicle includes a first subwoofer provided at a driver's seat side of the vehicle and having a first resonance frequency; a second subwoofer provided on a passenger seat side of the vehicle and having a second resonance frequency; and a controller configured to transmit an electrical signal corresponding to a play sound to the first subwoofer, to invert a phase of the electrical signal, and to transmit the electrical signal whose the phase is inverted to the second subwoofer.

The vehicle may further include a communicator. The controller may extract a low frequency band from the play sound received through the communicator, and transmit the electrical signal to the first subwoofer and the second subwoofer based on the electrical signal corresponding to the low frequency band.

The controller may adjust a position at which a sensitivity between the first resonance frequency and the second resonance frequency is maximized by adjusting a phase difference between the electrical signal transmitted to the first subwoofer and the electrical signal transmitted to the second subwoofer.

When at least one of a navigation guide sound or a warning sound among play sounds received through the communicator is included, the controller may adjust the phase difference between the electrical signal transmitted to the first subwoofer and the electrical signal transmitted to the second subwoofer so that the sensitivity of the low frequency band in the driver's seat is minimized.

The vehicle may further include an inputter configured to receive a user input. The controller may adjust the phase difference between the electrical signal transmitted to the first subwoofer and the electrical signal transmitted to the second subwoofer based on the user input inputted through the inputter.

The vehicle may further include a plurality of door woofers provided in each of a plurality of doors and having different resonance frequencies. The controller may transmit the electrical signal to at least one subwoofer of the first subwoofer or the second subwoofer and at least one door woofer of the plurality of door woofers based on the electrical signal corresponding to the low frequency band.

The first subwoofer or the second subwoofer do not include dampers.

In another form of the present disclosure, in a method of controlling a vehicle, the vehicle includes a first subwoofer provided at a driver's seat side of the vehicle and having a first resonance frequency, and a second subwoofer provided on a passenger seat side of the vehicle and having a second resonance frequency. The method of controlling the vehicle includes transmitting, an electrical signal corresponding to a play sound to the first subwoofer; inverting a phase of the electrical signal; and transmitting the electrical signal whose the phase is inverted to the second subwoofer.

The vehicle may further include a communicator. The method may further include extracting a low frequency band from the play sound received through the communicator; and transmitting the electrical signal to the first subwoofer and the second subwoofer based on the electrical signal corresponding to the low frequency band.

The method may further include adjusting a position at which a sensitivity between the first resonance frequency and the second resonance frequency is maximized by adjusting a phase difference between the electrical signal transmitted to the first subwoofer and the electrical signal transmitted to the second subwoofer.

The method may further include when at least one of a navigation guide sound or a warning sound among play sounds received through the communicator is included, adjusting the phase difference between the electrical signal transmitted to the first subwoofer and the electrical signal transmitted to the second subwoofer so that the sensitivity of the low frequency band in the driver's seat is minimized.

The vehicle may further include an inputter configured to receive a user input. The method may further include adjusting the phase difference between the electrical signal transmitted to the first subwoofer and the electrical signal transmitted to the second subwoofer based on the user input inputted through the inputter.

The vehicle may further include a plurality of door woofers provided in each of a plurality of doors and having different resonance frequencies. The method may further include transmitting the electrical signal to at least one subwoofer of the first subwoofer or the second subwoofer and at least one door woofer of the plurality of door woofers based on the electrical signal corresponding to the low frequency band.

The first subwoofer or the second subwoofer do not include dampers.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
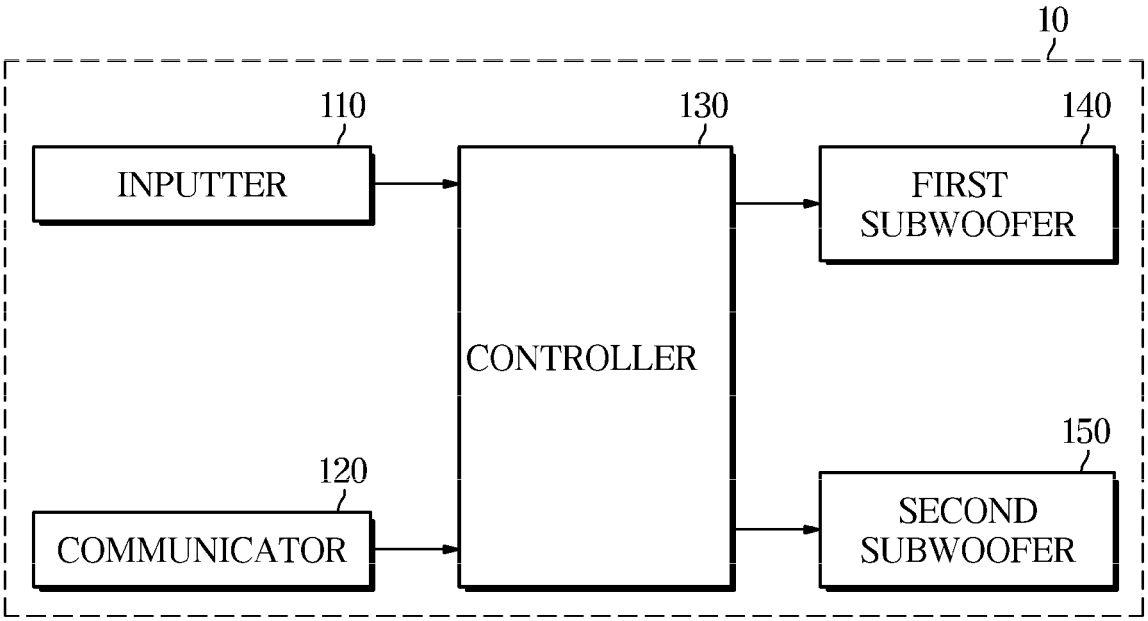
FIG. 1 is a control block diagram of a vehicle in one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

It will be understood that when a component is referred to as being "connected" to another component, it can be directly or indirectly connected to the other component. When a component is indirectly connected to another component, it may be connected to the other component through a wireless communication network.

Further, it will be understood that the terms "includes," "comprises," "including," and/or "comprising," when used in this specification, specify the presence of a stated component, but do not preclude the presence or addition of one or more other components.

Still further, it is to be understood that the singular forms "a," "an," and "the" include plural referents unless the context clearly dictates otherwise.

As used herein, the terms "portion," "unit," "block," "member," or "module" refer to a unit that can perform at least one function or operation. For example, these terms may refer to at least one piece of software stored in a memory or at least one piece of hardware, such as a Field Programmable Gate Array (FPGA) or an Application Specific Integrated Circuit (ASIC), or at least one process that is processed by a processor.

Reference numerals used in operations are provided for convenience of description, without describing the order of the operations, and the operations can be executed in a different order from the stated order unless a specific order is definitely specified in the context.

Hereinafter, a vehicle in some forms of the present disclosure and a method of controlling the vehicle will be described in detail with reference to the accompanying drawings.

FIG. 1 is a control block diagram of a vehicle in some forms of the present disclosure.

Referring to FIG. 1, a vehicle 10 may include an inputter 110 for receiving an input from a user, a communicator 120 for communicating with an electronic device outside the vehicle 10 or an electronic component inside the vehicle 10, a controller 130 for adjusting a phase of a play sound transmitted to subwoofers 140 and 150, a first subwoofer 140 provided on a driver's seat side of the vehicle 10 and having a first resonance frequency, and a second subwoofer 150 provided on a passenger seat side of the vehicle 10 and having a second resonance frequency.

The inputter 110 may receive the input from the user including a driver and a passenger.

In detail, the inputter 110 may receive a position where a sound of a low frequency band by the subwoofers 140 and 150 has a maximum sensitivity from the user.

In order words, the user, through the inputter 110 according to the preferences for the sound of the low frequency band, so that the position of the sound of the low frequency band having the maximum sensitivity may be adjusted to increase the sensitivity of the sound of the low frequency band or to decrease the sensitivity of the sound of the low frequency band is low at the position where the user is positioned.

The inputter 110 may be provided in a center fascia (not shown) and may be implemented with mechanical buttons, knobs, touch pad, touch screen, stick-type manipulation device, trackball, or the like. In addition, the inputter 110 may be integrated with a display (not shown) and implemented using a touch screen. The position and the type of the inputter 110 are not limited to the above-described example, and may be included without limitation as long as the position and the type of the user's input can be received.

The communicator 120 may communicate with the electronic device outside the vehicle 10 or the electronic component inside the vehicle 10.

In detail, the communicator 120 may receive a radio signal transmitted from a broadcasting station outside the vehicle 10, and may receive sound data from a terminal device outside the vehicle 10 using wireless communication.

The communicator 120 may correspond to a vehicle radio receiver, and the wireless communication may be, for example, 5th Generation (5G), Long-Term Evolution (LTE), LTE Advance (LTE-A), Code Division Multiple Access (CDMA), Wideband CDMA (WCDMA), Universal Mobile Telecommunications System (UMTS), wireless broadband (WiBro), Global System for Mobile communications (GSM), or the like. In some forms of the present disclosure, the wireless communication may include, for example, wireless fidelity (WiFi), Bluetooth, Bluetooth low power (BLE), Zigbee, Near Field Communication (NFC), Magnetic Secure Transmission Frequency (RF), or Body Area Network (BAN). However, forms of the present disclosure are not limited to the above example, and any communication protocol capable of performing the wireless communication may be used without limitation.

The communicator 120 may communicate with the electronic component inside the vehicle 10, for example, a navigation that outputs a guide sound, a lane departure warning device that outputs a warning sound, and the like through a vehicle communication network.

In order words, the communicator 120 may receive the guide sound or the warning sound from the electronic component inside the vehicle 10 through the vehicle communication network. However, the electronic component is not limited to the above example, and may be included without limitation as long as the electronic component inside the vehicle 10 outputting the guide sound or the warning sound.

In addition, the vehicle communication network may include Ethernet, Most Oriented Systems Transport (MOST), Flexray, Controller Area Network (CAN), Local Interconnect Network (LIN) and the like.

The communicator 120 may receive data about the sound to be played inside the vehicle 10 from the electronic device outside the vehicle 10 or an electronic component inside the vehicle 10, and may transmit data about the play sound to be played to the controller 130.

The controller 130 may transmit an electrical signal corresponding to the play sound received through the communicator 120 to the first subwoofer 140, and may transmit by inverting the phase of the electrical signal corresponding to the play sound by 180 degrees to the second subwoofer 150.

Through this, the frequency band between resonance frequencies of each of the first subwoofer 140 and the second subwoofer 150 may have high sensitivity output characteristics, which will be described in detail later.

Particularly, the controller 130 may extract the low frequency band from the play sound received through the communicator 120. That is, the controller 130 may extract the sound of the low frequency band to be played in the subwoofers 140 and 150 from the play sound.

Thereafter, the controller 130 may transmit the electrical signal to each of the first subwoofer 140 and the second subwoofer 150 based on the extracted electrical signal of the play sound of the low frequency band.

The controller 130 may adjust the position at which the sensitivity between the first resonance frequency and the second resonance frequency is maximized by adjusting a phase difference between the electrical signal transmitted to the first subwoofer 140 and the electrical signal delivered to the second subwoofer 150.

In order words, when the phase difference between the electrical signals transmitted to the first subwoofer 140 and the second subwoofer 150 corresponds to 180 degrees, the sensitivity between the first subwoofer 140 and the second subwoofer 150 may be maximized at the position in the center between the second subwoofer 150.

Therefore, the controller 130 may control the position at which the sensitivity between the first resonance frequency and the second resonance frequency is maximized to move toward the side of the driver's seat by lowering the phase difference between the electrical signals transmitted to the first subwoofer 140 and the second subwoofer 150 to less than 180 degrees. The controller 130 may control the position at which the sensitivity between the first resonance frequency and the second resonance frequency is maximized to move toward the side of the passenger seat by increasing the phase difference between the electrical signals transmitted to the first subwoofer 140 and the second subwoofer 150 to more than 180 degrees.

When at least one of a navigation guide sound or the warning sound among play sounds received through the communicator 120 is received, the controller 130 may adjust the phase difference between the electrical signal transmitted to the first subwoofer 140 and the electrical signal transmitted to the second subwoofer 150 so that the sensitivity of the low frequency band in the driver's seat is minimized.

In other words, when at least one of the navigation guide sound or the warning sound among the play sounds received through the communicator 120 is included, the controller 130 may adjust the phase difference between the electrical signal transmitted to the first subwoofer 140 and the electrical signal transmitted to the second subwoofer 150 so that the position at which the sensitivity between the first resonance frequency and the second resonance frequency is maximized is directed toward the side of the passenger seat.

It is possible to prevent the driver from hearing the navigation guide sound or the warning sound by the play sound of the low frequency band.

The controller 130 may adjust the phase difference between the electrical signal transmitted to the first subwoofer 140 and the electrical signal delivered to the second subwoofer 150 based on the user's input inputted through the inputter 110.

The user may determine whether to receive the sound of the low frequency band according to the user's preference.

The controller 130 may include at least one memory storing a program for performing the above-described operations and operations, which will be described below, and at least one processor for executing the stored program. When there are a plurality of the memories and processors, they may be integrated into one chip or provided at physically separated positions.

The first subwoofer 140 may receive the electrical signal for the sound of the low frequency band of the play sound to output the sound of the low frequency band. In this case, the first subwoofer 140 may be provided at the driver's seat side, for example, under the driver's seat, and may use a side seal as an enclosure.

In addition, the first subwoofer 140 may be designed to have the first resonance frequency different from the resonance frequency of the second subwoofer 150.

The second subwoofer 150 may receive the electrical signal for the sound of the low frequency band of the play sound to output the sound of the low frequency band. In this case, the second subwoofer 150 may be provided at the passenger seat side, for example, under the passenger seat, and may use the side seal as an enclosure.

In addition, the second subwoofer 150 may be designed to have the second resonance frequency different from the resonance frequency of the first subwoofer 140.

In addition, although not shown in FIG. 1, the vehicle 10 may include a plurality of door woofers (not shown) provided in each of a plurality of doors (not shown) having different resonance frequencies.

The controller 130 may transmit the electrical signal to at least one subwoofer of the first subwoofer 140 or the second subwoofer 150 based on an electrical signal corresponding to a low frequency band of the play sound received through the communicator 120 and at least one door woofer of the plurality of door woofers.

That is, the controller 130 may play the sound of the low frequency band based on a combination of the subwoofers 140 and 150 and the door woofer. At this time, the controller 130 may adjust the phase difference between the electrical signals transmitted to each of the subwoofer and the door woofer for playing the sound of the low frequency band, so that the sensitivity between the resonance frequencies of each of the subwoofer and the door woofer may be increased.

In the above, each configuration of the vehicle 10 was described in detail. Hereinafter, the sensitivity adjustment based on the phase difference between electrical signals transmitted to the subwoofers 140 and 150 of the vehicle 10 will be described in detail.

Figure 2:
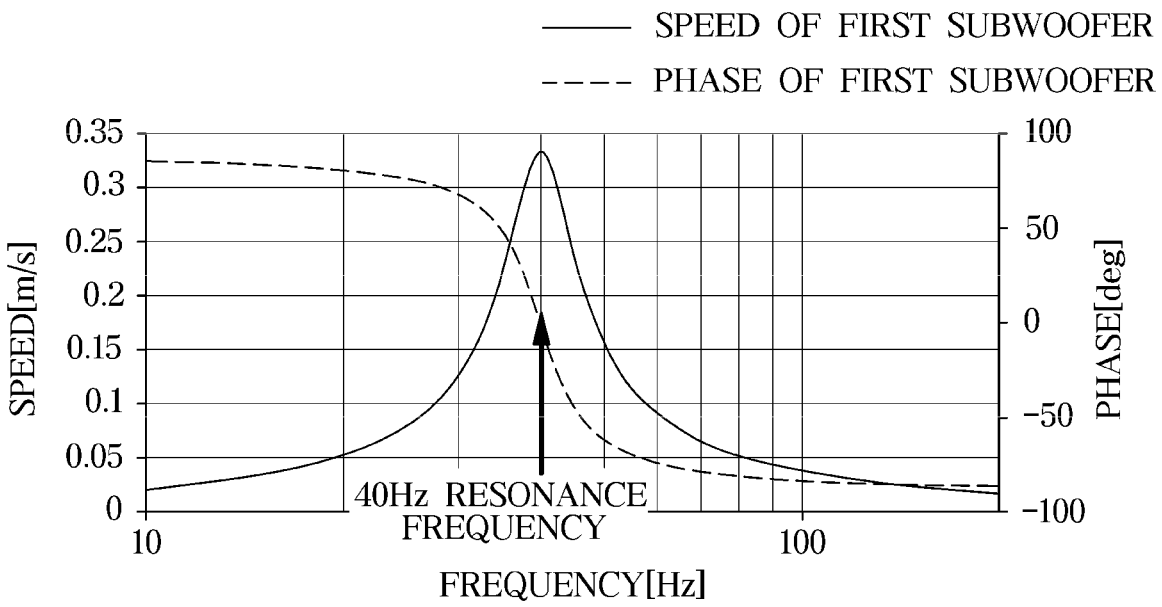
FIG. 2 is a view illustrating a speed and a phase according to a frequency of a subwoofer in one form of the present disclosure.
Figure 3:
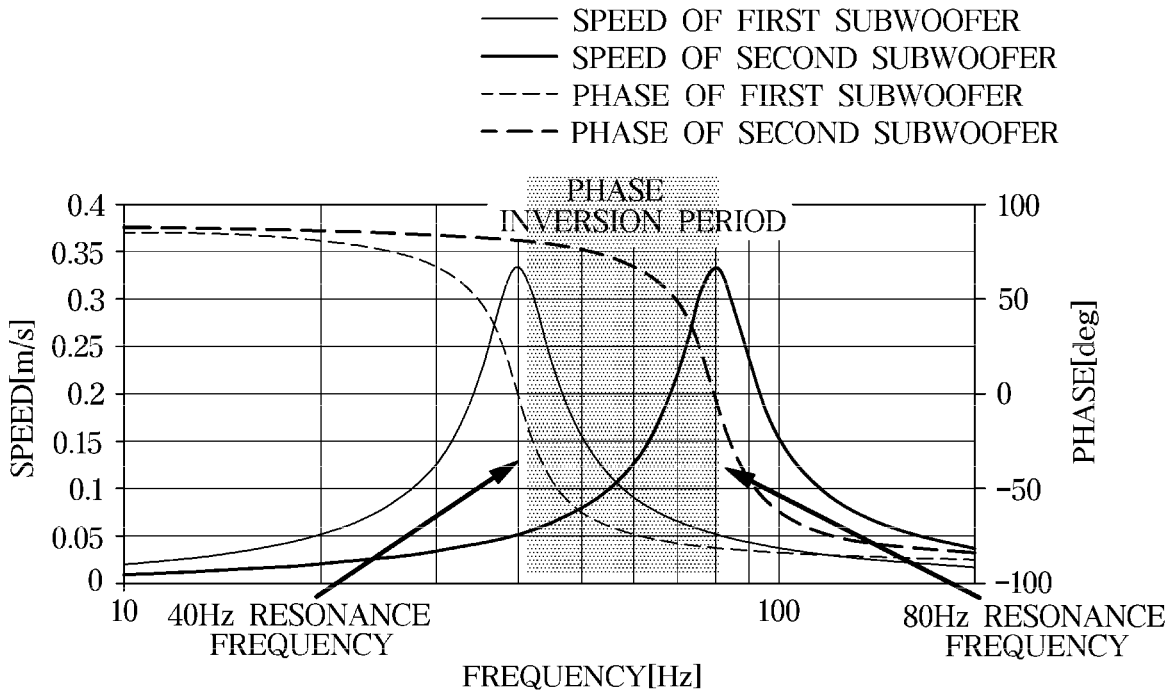
FIG. 3 is a view illustrating a case in which a signal having the same phase is transmitted to a first subwoofer and a second subwoofer in one form of the present disclosure.

FIG. 2 is a view illustrating a speed and a phase according to a frequency of a subwoofer in some forms of the present disclosure, and FIG. 3 is a view illustrating a case in which a signal having the same phase is transmitted to a first subwoofer and a second subwoofer in some forms of the present disclosure.

Referring to FIG. 2, the first subwoofer 140 may be designed to have the first resonance frequency (e.g., 40 Hz) as the resonance frequency. At this time, as illustrated in FIG. 2, the phase of a speaker cone of the first subwoofer 140 is inverted before and after the resonance frequency according to the characteristics of a structure, the speed of the speaker cone of the first subwoofer 140 may be the highest at the resonance frequency.

Particularly, it can be seen that the phase of the speaker cone of the first subwoofer 140 has a phase of +90 degrees before 40 Hz, but has a phase of −90 degrees after 40 Hz.

Accordingly, when using the plurality of subwoofers 140 and 150 having different resonance frequencies, as illustrated in FIG. 3, a phase inversion period in which phases of the speaker cones of the plurality of subwoofers 140 and 150 are opposite to each other may occur.

For example, when the electrical signal of the play sound is transmitted to each of the first subwoofer 140 having the first resonance frequency (e.g., 40 Hz) as the resonance frequency and the second subwoofer (150) having the second resonance frequency (e.g., 80 Hz) as the resonance frequency in the same phase, the phase of the speaker cone of the first subwoofer 140 may be inverted at 40 Hz, and the phase of the speaker cone of the second subwoofer 150 may be inverted at 80 Hz.

Accordingly, in the frequency band between 40 Hz and 80 Hz, a phase difference of 180 degrees may occur between the phase of the speaker cone of the first subwoofer 140 having the inverted phase and the phase of the speaker cone of the second subwoofer 150 having the non-inverted phase.

As a result, when the electrical signal of the same phase is applied to the first subwoofer 140 and the second subwoofer 150, a phenomenon in which the sensitivity between the first resonance frequency and the second resonance frequency is attenuated may occur, and thus, sound quality reduction within the frequency low band may occur.

Hereinafter, the transmission of the electrical signal having the phase difference to each of the first subwoofer 140 and the second subwoofer 150 in order to solve the sensitivity attenuation between the first resonance frequency and the second resonance frequency will be described.

Figure 4:
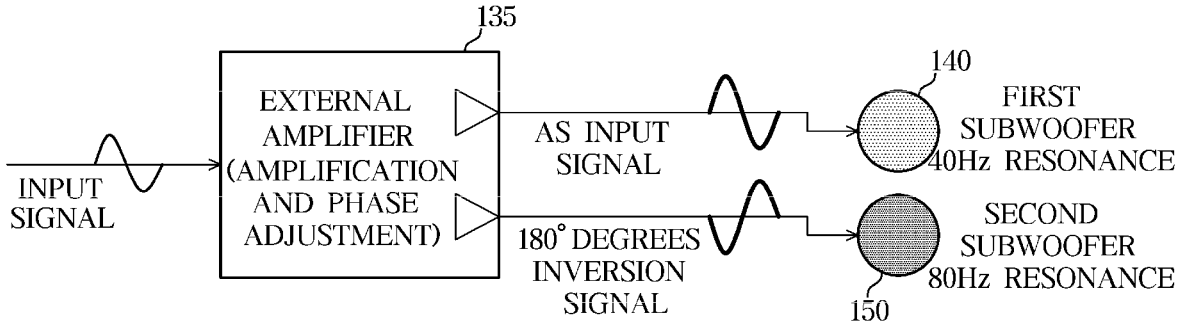
FIG. 4 is a view illustrating a case in which a vehicle transmits a signal having a different phase to a subwoofer in one form of the present disclosure.
Figure 5:
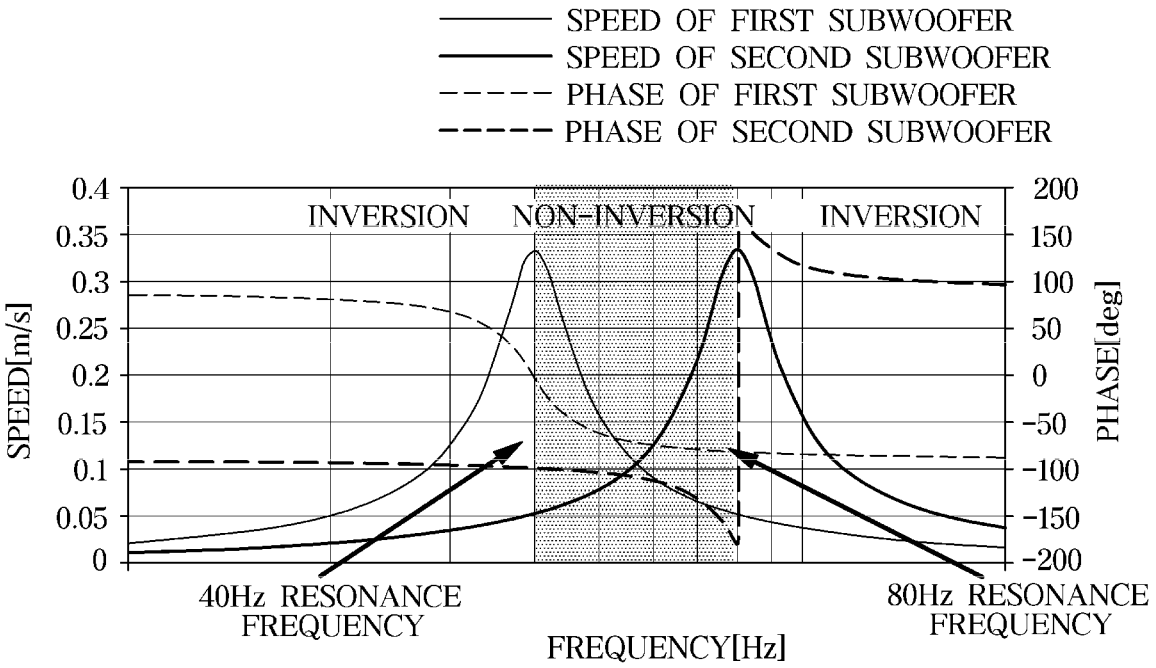
FIG. 5 is a view illustrating a case in which signals transmitted to a first subwoofer and a second subwoofer have opposite phases in one form of the present disclosure.
Figure 6:
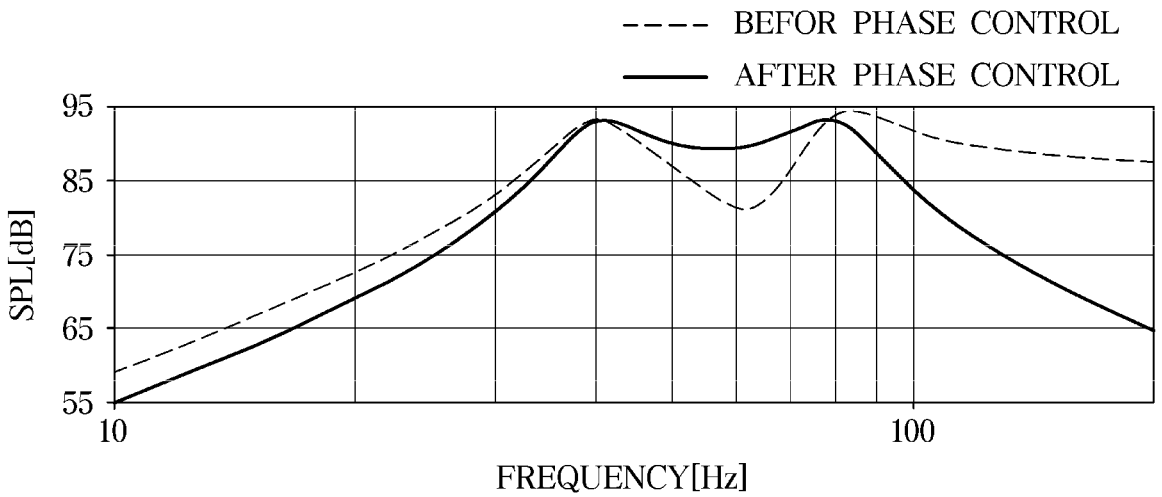
FIG. 6 is a view illustrating a sound pressure before and after a vehicle controls a phase of a subwoofer in one form of the present disclosure.

FIG. 4 is a view illustrating a case in which a vehicle transmits a signal having a different phase to a subwoofer in some forms of the present disclosure, FIG. 5 is a view illustrating a case in which signals transmitted to a first subwoofer and a second subwoofer have opposite phases in some forms of the present disclosure, and FIG. 6 is a view illustrating a sound pressure before and after a vehicle controls a phase of a subwoofer in some forms of the present disclosure.

Referring to FIG. 4, the controller 130 may transmit the electrical signal corresponding to the play sound received through the communicator 120 to the first subwoofer 140 to improve the sensitivity in the frequency band between the resonance frequencies of each of the first subwoofer 140 and the second subwoofer 150, and may transmit by inverting the phase of the electrical signal corresponding to the play sound by 180 degrees to the second subwoofer 150.

Particularly, the controller 130 may control an external amplifier 135 to amplify and phase adjust the input signal received through the communicator 120. The controller 130 may control an external amplifier so that the input signal is transmitted to the first subwoofer 140 as it is, and control the external amplifier 135 so that the signal inverted 180 degrees is transmitted to the second subwoofer 150.

In this case, as illustrated in FIG. 5, the phase of the speaker cone of the first subwoofer 140 and the phase of the speaker cone of the second subwoofer 150 in the frequency band between the first resonance frequency (e.g., 40 Hz) and the second resonance frequency (e.g., 80 Hz) may be the same.

In detail, the phase of the speaker cone of the first subwoofer 140 may be inverted to −90 degrees at 40 Hz, and the phase of the speaker cone of the second subwoofer 150 may be inverted to about +90 degrees at 80 Hz. Accordingly, the phase of the speaker cone of each of the first subwoofer 140 and the second subwoofer 150 may be equal to −90 degrees between 40 Hz and 80 Hz.

As illustrated in FIG. 6, the sensitivity in the frequency band between the first resonance frequency and the second resonance frequency may be higher when transmitting the electrical signal of the opposite phase to each of the first subwoofer 140 and the second subwoofer 150 through a phase control than when transmitting the electrical signal of the same phase to each of the first subwoofer 140 and the second subwoofer 150.

As such, the vehicle 10 may control the phase difference of the electrical signal transmitted to each of the first subwoofer 140 and the second subwoofer 150 to be 180 degrees, so that the sensitivity in the frequency band between the resonance frequencies of each of the first subwoofer 140 and the second subwoofer 150 may be improved.

Particularly, the controller 130 may extract the low frequency band from the play sound received through the communicator 120. That is, the controller 130 may extract the sound of the low frequency band to be played in the subwoofers 140 and 150 from the play sound.

Thereafter, the controller 130 may transmit the electrical signal to each of the first subwoofer 140 and the second subwoofer 150 based on the extracted electrical signal of the play sound of the low frequency band.

The controller 130 may adjust the position at which the sensitivity between the first resonance frequency and the second resonance frequency is maximized by adjusting a phase difference between the electrical signal transmitted to the first subwoofer 140 and the electrical signal delivered to the second subwoofer 150.

In order words, when the phase difference between the electrical signals transmitted to the first subwoofer 140 and the second subwoofer 150 corresponds to 180 degrees, the sensitivity between the first subwoofer 140 and the second subwoofer 150 may be maximized at the position in the center between the second subwoofer 150.

Therefore, the controller 130 may control the position at which the sensitivity between the first resonance frequency and the second resonance frequency is maximized to move toward the side of the driver's seat by lowering the phase difference between the electrical signals transmitted to the first subwoofer 140 and the second subwoofer 150 to less than 180 degrees. The controller 130 may control the position at which the sensitivity between the first resonance frequency and the second resonance frequency is maximized to move toward the side of the passenger seat by increasing the phase difference between the electrical signals transmitted to the first subwoofer 140 and the second subwoofer 150 to more than 180 degrees.

When at least one of a navigation guide sound or the warning sound among play sounds received through the communicator 120 is received, the controller 130 may adjust the phase difference between the electrical signal transmitted to the first subwoofer 140 and the electrical signal transmitted to the second subwoofer 150 so that the sensitivity of the low frequency band in the driver's seat is minimized.

In other words, when at least one of the navigation guide sound or the warning sound among the play sounds received through the communicator 120 is included, the controller 130 may adjust the phase difference between the electrical signal transmitted to the first subwoofer 140 and the electrical signal transmitted to the second subwoofer 150 so that the position at which the sensitivity between the first resonance frequency and the second resonance frequency is maximized is directed toward the side of the passenger seat.

It is possible to prevent the driver from hearing the navigation guide sound or the warning sound by the play sound of the low frequency band.

The controller 130 may adjust the phase difference between the electrical signal transmitted to the first subwoofer 140 and the electrical signal delivered to the second subwoofer 150 based on the user's input inputted through the inputter 110.

The user may determine whether to receive the sound of the low frequency band according to the user's preference.

In the above it has been described to control the phase difference between the electrical signal of the play sound transmitted to the subwoofers 140 and 150. Hereinafter, the damper (not shown) is not included in the subwoofers 140 and 150 in detail.

Figure 7:
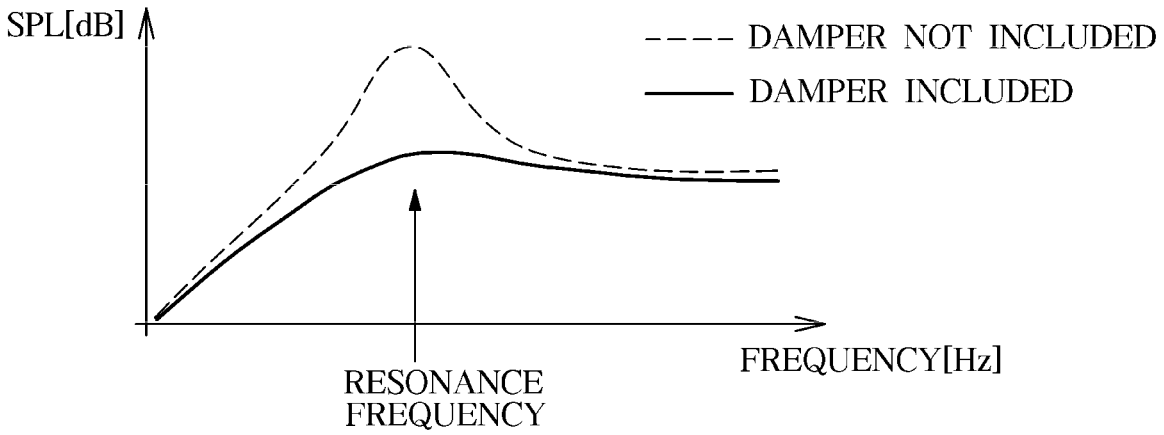
FIG. 7 is a view illustrating a sound pressure depending on the presence or absence of a damper in a subwoofer in one form of the present disclosure.
Figure 8:
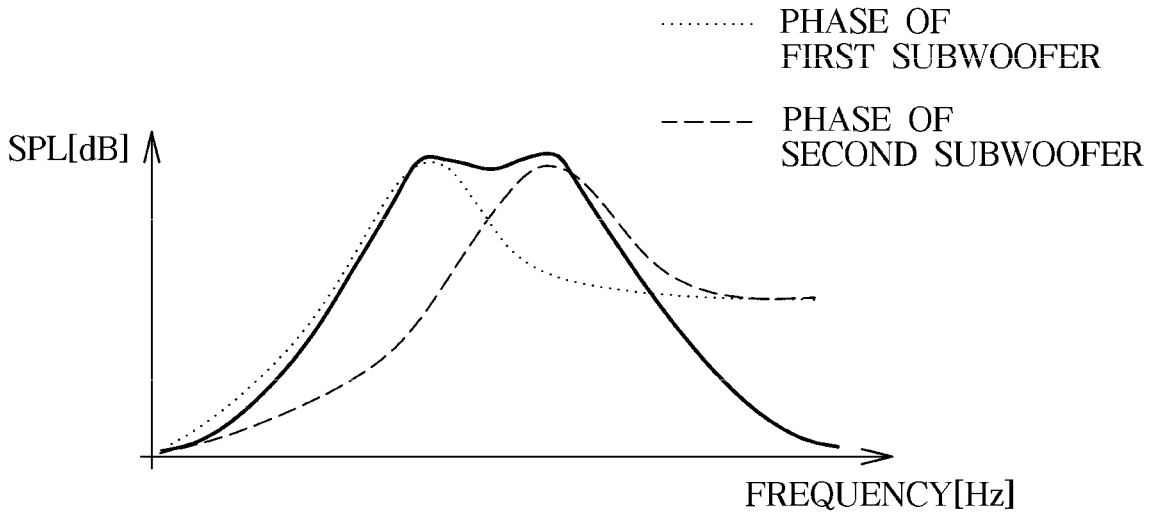
FIG. 8 is a view illustrating a case in which signals of opposite phases are transmitted to subwoofers that do not include dampers in one form of the present disclosure.

FIG. 7 is a view illustrating a sound pressure depending on the presence or absence of a damper in a subwoofer in some forms of the present disclosure, and FIG. 8 is a view illustrating a case in which signals of opposite phases are transmitted to subwoofers that do not include dampers in some forms of the present disclosure.

Referring to FIG. 7, the subwoofers 140 and 150 may include dampers that absorb vibration energy. When the subwoofers 140 and 150 include the dampers, the subwoofers 140 and 150 may exhibit flat sound pressure characteristics after the resonance frequency, that is, broadband characteristics. However, the damper that absorbs the vibration energy may cause attenuation of a sound pressure, thereby lowering energy efficiency.

In order words, when the subwoofers 140 and 150 do not include the dampers, the subwoofers 140 and 150 may have a higher sound pressure, that is, a higher sensitivity at the resonance frequency. However, as illustrated in FIG. 7, when the subwoofers 140 and 150 do not include the dampers, the subwoofers 140 and 150 may not have the broadband characteristics due to peaks at resonance frequencies.

The subwoofers 140 and 150 may not include the dampers that absorb the vibration energy. At this time, the controller 130 may control the phase difference between the electrical signal of the play sound transmitted to the first subwoofer 140 and the electrical signal of the play sound transmitted to the second subwoofer 150 by 180 degrees.

Accordingly, as illustrated in FIG. 8, in the frequency band between the first resonance frequency of the first subwoofer 140 and the second resonance frequency of the second subwoofer 150, the high sensitivity and flat sound pressure may be obtained, resulting in the broadband characteristics.

That is, the vehicle 10 may use subwoofers 140 and 150 that do not include dampers, and may control the phase difference of electrical signals transmitted to the subwoofers 140 and 150. Thus, the vehicle 10 may overcome the characteristics of narrowing the frequency band that may occur because the subwoofers 140 and 150 do not including the dampers.

Through this, it is possible to reduce the cost of using the dampers, to increase the reliability of a manufacturing process of the subwoofer, and to increase the energy efficiency by eliminating the attenuation effect due to the dampers.

Hereinafter, a control method of the vehicle 10 will be described. The vehicle 10 in some forms of the present disclosure may be applied to the control method of the vehicle 10, as will be described later. Therefore, descriptions given above with reference to FIGS. 1 to 8 may be applied to the control method of the vehicle 10 in the same manner, unless otherwise noted.

Figure 9:
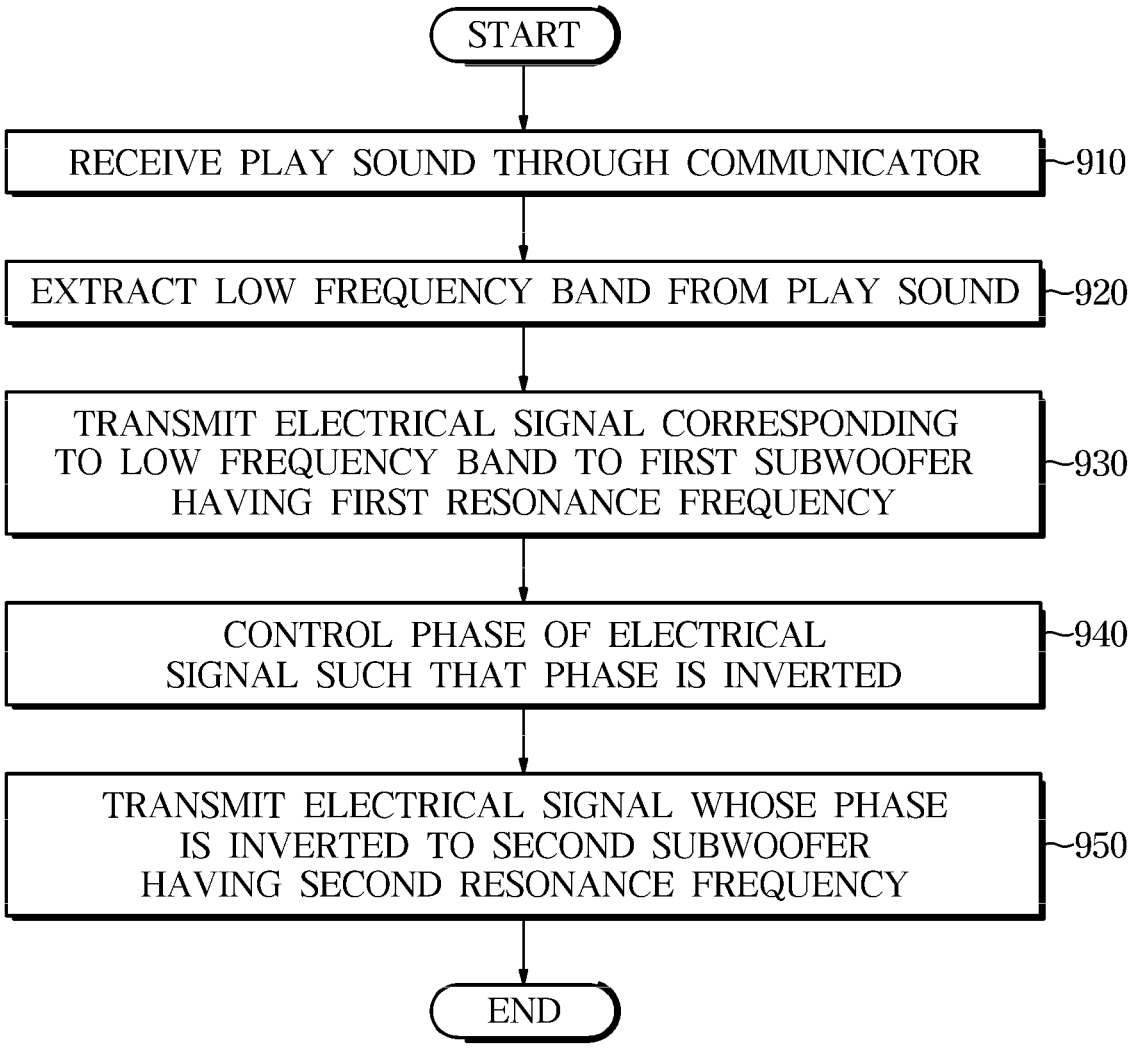
FIG. 9 is a flowchart illustrating a case in which an electrical signal having a different phase is transmitted to different subwoofers in a control method of a vehicle in one form of the present disclosure.

FIG. 9 is a flowchart illustrating a case in which an electrical signal having a different phase is transmitted to different subwoofers in a control method of a vehicle in some forms of the present disclosure.

Referring to FIG. 9, the vehicle 10 may receive the play sound through the communicator 120 (910).

The vehicle 10 may extract the low frequency band from the play sound (920), and may transmit the electrical signal corresponding to the low frequency band to the first subwoofer 140 having the first resonance frequency (930).

In addition, the vehicle 10 may control the phase of the electrical signal such that the phase is inverted (940), and may transmit the electrical signal whose phase is inverted to the second subwoofer 150 having the second resonance frequency (950). Through this, the frequency band between resonance frequencies of each of the first subwoofer 140 and the second subwoofer 150 may have the high sensitivity output characteristics.

As is apparent from the above description, the vehicle and the method of controlling the vehicle in some forms of the present disclosure, by using the phase difference between the plurality of subwoofers to increase the sensitivity of the subwoofer in the vehicle, it is possible to provide a richer low-frequency sound to the user.

Meanwhile, some forms of the present disclosure may be implemented in the form of a recording medium storing instructions that are executable by a computer. The instructions may be stored in the form of a program code, and when executed by a processor, the instructions may generate a program module to perform operations of some forms of the present disclosure. The recording medium may be implemented non-transitory as a computer-readable recording medium.

The non-transitory computer-readable recording medium may include all kinds of recording media storing commands that can be interpreted by a computer. For example, the non-transitory computer-readable recording medium may be, for example, ROM, RAM, a magnetic tape, a magnetic disc, flash memory, an optical data storage device, etc.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A vehicle comprising:

a first subwoofer provided at a driver's seat side of the vehicle and having a first resonance frequency;

a second subwoofer provided on a passenger seat side of the vehicle and having a second resonance frequency; and a controller configured to:

transmit an electrical signal corresponding to a play sound to the first subwoofer;

invert a phase of the electrical signal; and transmit, to the second subwoofer, the inverted electrical signal.

2. The vehicle of claim 1, wherein the vehicle further comprises:

a communicator, wherein the controller is configured to:

extract a low frequency band from the play sound; and transmit the electrical signal to the first subwoofer and the second subwoofer based on the electrical signal corresponding to the low frequency band.

3. The vehicle of claim 2, wherein the controller is configured to:

adjust a position at which a sensitivity between the first resonance frequency and the second resonance frequency is increased by adjusting a phase difference between the electrical signal transmitted to the first subwoofer and the electrical signal transmitted to the second subwoofer.

4. The vehicle of claim 3, wherein, when at least one of a navigation guide sound or a warning sound among play sounds received through the communicator is included, the controller is configured to adjust the phase difference between the electrical signal transmitted to the first subwoofer and the electrical signal transmitted to the second subwoofer such that the sensitivity of the low frequency band in the driver's seat is reduced.

5. The vehicle of claim 3, wherein:

the vehicle further comprises:

an inputter configured to receive a user input, and the controller is configured to adjust the phase difference between the electrical signal transmitted to the first subwoofer and the electrical signal transmitted to the second subwoofer based on the user input.

6. The vehicle of claim 2, wherein:

the vehicle further comprises:

a plurality of door woofers provided in each door of a plurality of doors and having different resonance frequencies, and the controller is configured to transmit the electrical signal to at least one subwoofer of the first subwoofer or the second subwoofer and at least one door woofer of the plurality of door woofers based on the electrical signal corresponding to the low frequency band.

7. The vehicle of claim 1, wherein the first subwoofer or the second subwoofer does not include dampers.

8. A method of controlling a vehicle, the method comprising:

transmitting an electrical signal corresponding to a play sound to a first subwoofer, wherein the first subwoofer is provided at a driver's seat side of the vehicle and has a first resonance frequency;

inverting a phase of the electrical signal; and transmitting the phased electrical signal to a second subwoofer, wherein the second subwoofer is provided on a passenger seat side of the vehicle and has a second resonance frequency.

9. The method of claim 8, wherein the method further comprises:

extracting a low frequency band from the play sound received through a communicator; and transmitting the electrical signal to the first subwoofer and the second subwoofer based on the electrical signal corresponding to the low frequency band.

10. The method of claim 9, wherein the method further comprises:

adjusting a position at which a sensitivity between the first resonance frequency and the second resonance frequency is increased by adjusting a phase difference between the electrical signal transmitted to the first subwoofer and the electrical signal transmitted to the second subwoofer.

11. The method of claim 10, wherein the method further comprises:

when at least one of a navigation guide sound or a warning sound among the play sound is included, adjusting the phase difference between the electrical signal transmitted to the first subwoofer and the electrical signal transmitted to the second subwoofer such that the sensitivity of the low frequency band in the driver's seat is reduced.

12. The method of claim 10, wherein the method further comprises:

adjusting the phase difference between the electrical signal transmitted to the first subwoofer and the electrical signal transmitted to the second subwoofer based on a user input inputted through an inputter.

13. The method of claim 9, wherein the method further comprises:

transmitting the electrical signal to at least one subwoofer of the first subwoofer or the second subwoofer and at least one door woofer of a plurality of door woofers based on the electrical signal corresponding to the low frequency band, wherein the plurality of door woofers are provided in each door of a plurality of doors and have different resonance frequencies.

14. The method of claim 8, wherein the first subwoofer or the second subwoofer does not include dampers.

* * * * *